US008206560B2

(12) United States Patent
Feng

(10) Patent No.: US 8,206,560 B2
(45) Date of Patent: Jun. 26, 2012

(54) ALUMINUM ELECTROLYTIC CELLS HAVING HETEROTYPIC STRUCTURED CATHODE CARBON BLOCKS

(75) Inventor: Naixiang Feng, Liaoning (CN)

(73) Assignees: Northeastern University Engineering & Research Institute Co, Ltd. (CN); Northeastern University (CN); Shenyang Beiye Metallurgical Technology Co., Ltd. (CN)

( * ) Notice: Subject to any disclaimer, the term of this patent is extended or adjusted under 35 U.S.C. 154(b) by 266 days.

(21) Appl. No.: 12/529,296

(22) PCT Filed: Dec. 17, 2007

(86) PCT No.: PCT/CN2007/003625

§ 371 (c)(1),
(2), (4) Date: Dec. 7, 2009

(87) PCT Pub. No.: WO2008/106849

PCT Pub. Date: Sep. 12, 2008

(65) Prior Publication Data

US 2010/0147678 A1 Jun. 17, 2010

(30) Foreign Application Priority Data

Mar. 2, 2007 (CN) ..... 2007 1 0010523

(51) Int. Cl.
*C25C 3/08* (2006.01)

(52) U.S. Cl. ..... 204/247.4; 204/243.1; 204/247.5; 204/245

(58) Field of Classification Search ..... 204/243.1, 204/247.4, 247.5
See application file for complete search history.

(56) References Cited

U.S. PATENT DOCUMENTS 4,424,281 A * 1/1984 Jones ..... 501/89
(Continued)

FOREIGN PATENT DOCUMENTS

CN 1718866 A 1/2006
(Continued)

OTHER PUBLICATIONS

"International Application Serial No. PCT/CN2007/003625, International Preliminary Report on Patentability completed Jul. 2, 2009", (w/ English Translation), 24 pgs.

(Continued)

*Primary Examiner* — Bruce Bell
(74) *Attorney, Agent, or Firm* — Schwegman, Lunderberg & Woessner, P.A.

(57) ABSTRACT

Disclosed is an aluminum electrolytic cell having profiled cathode carbon blocks structures, comprising a cell case, a refractory material installed on the bottom, an anodes and a cathode. The cathode carbon blocks include a profiled structure having projections on the top surface of the carbon blocks, that is, a plurality of projections are formed on a surface of the cathode carbon blocks. The aluminum electrolytic cell having the cathode structure according to the present invention can reduce the velocity of the flow and the fluctuation of the level of the cathodal molten aluminum within the electrolytic cell, so as to increase the stability of the surface of molten aluminum, reduce the molten lose of the aluminum, increase the current efficiency, reduce the inter electrode distance, and reduce the energy consumption of the production of aluminum by electrolysis. With the above configuration, compounds or precipitates of viscous cryolite molten alumina can be formed on the lower portion between walls protruding on the upper surface of the cathode, which can prohibit the molten aluminum from flowing into the cell bottom through the cracks and apertures on cathodes, so that the life of the electrolytic cell can be extended.

3 Claims, 6 Drawing Sheets

U.S. PATENT DOCUMENTS

| | | | | | |
|---|---|---|---|---|---|
| 5,167,787 | A | * | 12/1992 | Hudson et al. | 204/247.4 |
| 5,683,559 | A | | 11/1997 | de Nora et al. | |
| 5,888,360 | A | * | 3/1999 | de Nora | 205/384 |
| 6,436,273 | B1 | | 8/2002 | de Nora et al. | |

FOREIGN PATENT DOCUMENTS

| | | | |
|---|---|---|---|
| CN | 1724712 | A | 1/2006 |
| CN | 1763255 | A | 4/2006 |
| WO | WO-99/02764 | A1 | 1/1999 |

OTHER PUBLICATIONS

"International Application Serial No. PCT/CN2007/003625, Written Opinion mailed Mar. 20, 2008", (w/ English Translation), 10 pgs.
"International Application Serial No. PCT/CN2007/003625, International Search Report mailed Mar. 20, 2008", (w/ English Translation), 6 pgs.

* cited by examiner

ALUMINUM ELECTROLYTIC CELLS HAVING HETEROTYPIC STRUCTURED CATHODE CARBON BLOCKS

RELATED APPLICATIONS

This application is a nationalization under 35 U.S.C. 371 of PCT/CN2007/003625, filed Dec. 17, 2007 and published as WO 2008/106849 A1 on Sep. 12, 2008, which claimed priority under 35 U.S.C. 119 to Chinese Patent Application Serial No. 200710010523.4, filed Mar. 2, 2007; which applications and publication are incorporated herein by reference and made a part hereof.

FIELD OF INVENTION

The present invention relates to the technical field of aluminum electrolysis, more particular, to an aluminum electrolytic cell for producing aluminum through a fused salt electrolysis process.

BACKGROUND OF INVENTION

Presently, the industrial pure aluminum is primarily produced by cryolite-alumina fused salt. A dedicated device usually employed in the above process includes an electrolytic cell of which the inside is lined with carbon materials.

Refractory materials and heat insulating bricks are provided between a steel case and a carbon liner of the electrolytic cell. The carbon liner within the electrolytic cell is generally structured by laying carbon bricks (or blocks) made of anthracites or graphite materials or the compound thereof, which has a better anti-sodium or anti-electrolytic corrosivity. Carbon pastes made in above carbon materials are tamped at a joint between the bricks or blocks. A steel rod is disposed at the bottom of the carbon blocks at the bottom of the electrolytic cell and extended out of the case of the electrolysis cell. Such steel rod is usually referred to a cathode steel rod of the electrolysis cell. A carbon anode made of petroleum coke is suspended above the electrolysis cell. An anode guide rod made in metal is disposed above the anode of the electrolysis cell, through which the current is led in. Molten aluminum and cryolite-alumina electrolyte melt having a temperature between 940-970° C. are provided between the carbon cathode and the carbon anode of the electrolysis cell. The molten aluminum and the electrolyte melt are not fused from each other, and the density of the aluminum is lager than that of the electrolyte melt, thus, the aluminum is contacted with the carbon cathode below the electrolyte melt. When a direct current is led from the carbon anode of the electrolytic cell and led out of the carbon cathode thereof; since the electrolyte melt is an ionic conductor, the cryolite molten with alumina is electrochemically reacted at the cathode and the anode. Accordingly, a reaction that the oxygen produced by the oxygen-carrying ion being discharged on the anode reacts with the carbon on the carbon anode is carried out, and the electrolyte resulting from the reaction in the $CO_2$ form is escaped from the surface of the anode. Aluminum-carrying ion is discharged on the cathode so as to obtain three electrons to generate metal aluminum. This cathode reaction is performed on the surface of the molten aluminum within the electrolytic cell. The inter electrode distance refers to the distance between the cathode surface and the bottom surface of the carbon anode within the electrolytic cell. Typically, in the industrial aluminum electrolytic cell, the inter electrode distance within the electrolytic cell is 4-5 cm. The inter electrode distance generally is a crucial technical parameter in the industrial aluminum electrolytic production, the inter electrode distance with too high or too low value will impose great influence the aluminum electrolytic production.

More specifically, the inter electrode distance with too low value may increase a secondary reaction between the metal aluminum molten from the cathode surface into the electrolytic melt and the anode gas, so that the current efficiency is reduced.

The inter electrode distance with too high value may increase the cell voltage within the electrolytic cell, so that the power consumption for the direct current of the production of the aluminum electrolyzing is increased.

For the production of the aluminum electrolyzing, it is desired that the electrolytic cell has the highest current efficiency and the lowest power consumption, during the aluminum electrolyzing, the power consumption for the direct current can be presented by following formula:

$$W(\text{kilowatt-hour/ton of aluminum})=2980*Va/CE$$

Wherein the Va is an average cell voltage (V) within the electrolytic cell, CE is the current efficiency of electrolytic cell (%).

It can be seen from above formula, the goal of reducing the power consumption for aluminum electrolyzing production can be realized by increasing the current efficiency of electrolytic cell and reducing the average cell voltage within the electrolytic cell.

The inter electrode distance of the electrolytic cell is an important process and technical parameter for determining the size of the cell voltage. For the existing conventional industrial electrolytic cell, the cell voltage is reduced about 35-40 mV by reducing 1 mm of inter electrode distance, thus, it can be seen from formula (1), while the current efficiency of electrolytic cell is not reduced, the direct current power consumption for production of the aluminum electrolyzing can reduce over 100 kilowatt-hour per ton of aluminum. Therefore, it can be seen that reducing the inter electrode distance is advantageously benefit for the power consumption for production of the aluminum electrolyzing under the circumstance of the current efficiency not being effected. Typically, the inter electrode distance of industrial aluminum electrolytic cell is about 4.0-5.0 cm, which is measured by bringing out of the cold steel towline from the electrolytic cell after the cold steel towline having a hook sized about 15 mm vertically extended into the electrolyte melt of the electrolytic cell and uprightly hooked on the bottom top lift of the anode in about 1 minute. That is, the distance is the one between the molten aluminum surface and the top lift of the bottom of the anode which is obtained by using the interface between the aluminum and the electrolyte. Obviously, such distance is not the real inter electrode distance of the electrolytic cell because the molten aluminum surface is waved or fluctuated when the molten aluminum surface within the electrolytic cell is undergoing the electromagnetic force within the electrolytic cell or the anode gas is escaped from the anode.

It can be found in the literature that the wave crest height of the molten aluminum surface at the cathode of the electrolytic cell is about 2.0 cm. If the molten aluminum in the electrolytic cell is not waved, the electrolytic cell can perform electrolyzing production when the inter electrode distance is 2.0 to 3.0 cm. Thus, the cell voltage can reduce 0.7-1.0 v, so that the target of saving the power consumption of the electrolytic cell about 2000 to 3000 kilowatt-hour/ton of aluminum can be achieved. Based on such fundamentals, several aerial drainage type $TiB_2$/C cathode electrolytic cells without molten aluminum waved at the cathode have been developed and put into the industrial experiments, the highest current strength of the aerial drainage type $TiB_2/C$ cathode electrolytic cell is reached to 70 KA, the cathode current density is reached to 0.99 $A.cm^{-2}$, and the power consumption is 1280 killowatt-hour/ton of aluminum. However, according to the information obtained from the Sixth International Aluminum Electrolyzing Technique Conference in Australia, such experiment only tests for 70 days. There is no more information about such experiment and applications since the aforesaid experiment 8 years ago.

According to the experiment result for self-heated 1350-2000 A aerial drainage type $TiB_2/C$ cathode electrolytic cell supported by China Natural Science Fund, such electrolytic cell has an unexpected defect. That is, the over voltage of the cathode of the aerial drainage type $TiB_2/C$ cathode electrolytic cell is too high, i.e., higher than the normal one about 0.5 v. Although the fundamentals and mechanisms of the above phenomena are not quite clear, one reason may be considered. Specifically, as a result of polarization of the cathode, a macromolecule cryolite is formed on the cathode surface, and the macromolecule cryolite is slow in diffusion and mass transport, so that concentration polarization over voltage on the cathode surface is generated. Up to now, there is no solution to solve above problem, so the development and research of such aerial drainage type $TiB_2/C$ cathode the electrolytic cell is impeded. An other serious disadvantage of the aerial drainage type $TiB_2/C$ cathode electrolytic cell is: there is not enough amount of molten aluminum in the cathode, so that the heat stability of the electrolytic cell is poor, particularly, the huge amount of heat momentarily produced in the electrolytic cell under the anode effect is unable to dissipated through the molten aluminum having good heat conductivity or stored by the molten aluminum.

Moreover, the existing aluminum electrolytic cell is not good in life span; the longest life span for the cathode only has 2500-3000 days. In those disrepaired electrolytic cells, most of them are damaged in the early period, that is, it is caused by, in the early period of the production within the electrolytic cell, the cathode molten aluminum within the cell is leaked to the cell bottom to melt and corrode the cathode steel rod through cracks formed at the bonding portion between the cathode carbon blocks internally lined in the cell bottom and the carbon pastes during burning and producing, or through the crack produced on the carbon blocks body during burning.

SUMMARY OF INVENTION

In view of the above, the present invention is made to solve or alleviate at least one aspect of the disadvantages in association with the current aerial drainage type $TiB_2/C$ cathode electrolytic cell. Also, the present invention aims to solve the problems that large fluctuation of the surface level of cathode molten aluminum within the current industrial aluminum electrolytic cell, the inter electrode distance is limited, the cell voltage within the electrolytic cell can not be further decreased, as well as the poor life span of the electrolytic cell.

In order to achieve the above, a specific solution is provided as follows: an aluminum electrolytic cell according to the present invention comprises a cell case, a carbon anode, a bottom carbon internal lining, and refractory and heat insulating materials provided between the bottom carbon internal lining and the cell case, the bottom carbon internal lining is composed of a plurality of cathode carbon blocks, wherein each cathode carbon block comprises a connecting part at a bottom end and a protruding part at a top end, the connecting part being formed integrally with the protruding part, the connecting parts of the adjacent cathode carbon blocks are connected by tamping carbon pastes, and grooves in a longitudinal direction of the cathode carbon block are formed between the adjacent protruding parts of the adjacent cathode carbon blocks, each protruding part of the cathode carbon block comprises 2-8 protruding portions which are arranged at a block.

Accordingly, an object of the present invention is to provide an aluminum electrolytic cell having profiled cathode carbon blocks in which a plurality of protruding walls are formed on a cathode surface of the electrolytic cell.

According to an embodiment of the invention, there is provided an aluminum electrolytic cell, comprising a cell case, refractory and heat insulating materials provided on a bottom, side carbon blocks internally lined in the side portion of the electrode cell, a set of cathode carbon blocks provided with cathode steel rod, and carbon pastes provided between the cathode carbon blocks.

In an exemplified embodiment, the cathode of the electrolytic cell is structured as follows: a plurality of profiled cathode carbon blocks having protruding portions on upper surfaces thereof are arranged in the electrolytic cell and connected integrally with each other. The profiled cathode carbon blocks and the cathode carbon blocks of the conventional electrolytic cell may be made of the same material. In an example, the profiled cathode carbon blocks may be made from anthracites or artificial graphite crumbs or the compound thereof having projections on an upper surface thereof, also, such cathode carbon blocks can be made from graphitized or semi-graphitized carbon blocks having projections on an upper surface thereof.

The electrolytic cell built by such profiled cathode carbon blocks having protruding portions on the upper surfaces thereof provides a plurality of protruding portions which are parallel to direction of a series of current and disposed upright from the bottom surface of the electrolytic cell. The protruding portions are formed as components of cathode blocks of the electrolytic cell. Each cathode block may have 1 to 8 such protruding portions. In an example, each cathode block has 2 protruding portions, each protruding portion has a length being identical with the length of the anode provided thereon and perpendicular to longitudinal direction of the electrolytic cell, the width thereof is smaller than the width of the base cathode carbon blocks at the bottom thereof, and the height thereof is 6-25 cm.

In an alternative example, each cathode carbon block has one protruding portion on the upper surface thereof, the length of protruding portion is identical with that of the bottom cathode carbon blocks.

The method of producing aluminum by using the electrolytic cell having profiled cathode carbon blocks structure of the present invention is substantially the same as the method by using the conventional aluminum electrolytic cell.

The molten aluminum level within the electrolytic cell calculated from the upper surfaces of the walls protruded from the surface of the cell bottom is about 3-20 cm, the cell voltage is about 3.0-4.5 v, the level of the electrolyte above the molten aluminum is about 15-25 cm, the inter electrode distance of the electrolytic cell is about 2.5-5.0 cm, the electrolyte temperature is about 935-975° C., the molecular ratio of the electrolyte is about 2.0-28, the concentration of alumina is about 1.5-5%. Under above process conditions, the electrolytic reaction reacted on the cathode of the electrolytic reaction is: $Al^{3+}(complex)+3e=Al$.

The aluminum electrolytic cell having profiled cathode carbon blocks according to the present invention can reduce the velocity of the flow and fluctuation of the level of cathodal molten aluminum within the electrolytic cell, so as to increase the stability of the surface of molten aluminum, reduce the molten lose of the aluminum, increase the current efficiency, reduce the inter electrode distance, and reduce the energy consumption of the production of aluminum by electrolysis. Further, the compounds or precipitates of viscous cryolite molten alumina can be formed on the lower portion between walls protruding on the upper surface of the cathode, which can prohibit the molten aluminum from flowing into the cell bottom through the cracks and apertures on the cathodes, so that the life of the electrolytic cell can be extended.

Figure 1:
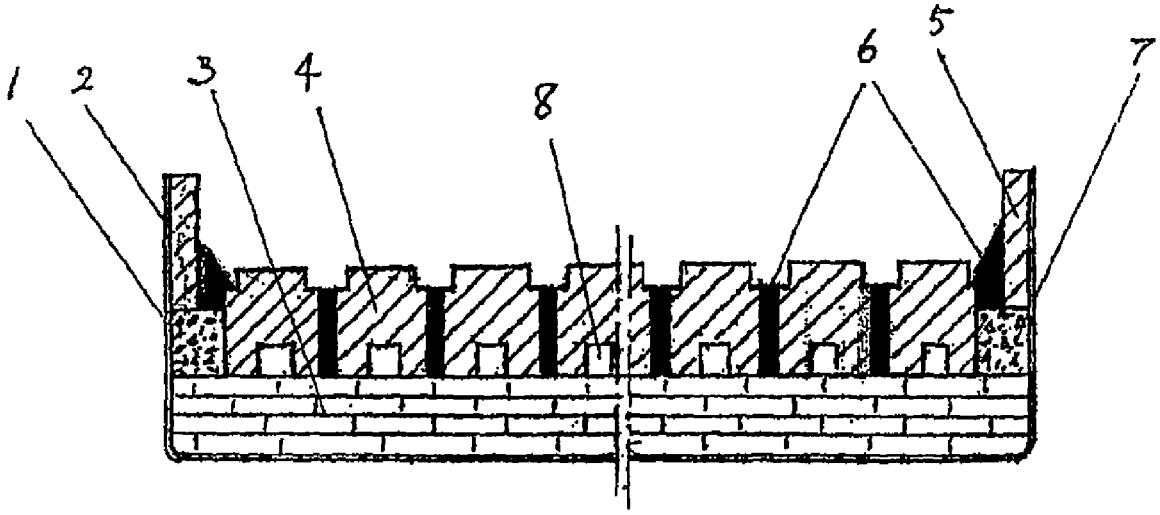
FIG. 1 is shown a structural view for an aluminum electrolytic cell having two protruding portions on an upper surface of each cathode carbon block according to one embodiment of the present invention, wherein the cross section of the protruding portion vertical to longitudinal direction of the cathode carbon block is shaped in rectangle.
Figure 2:
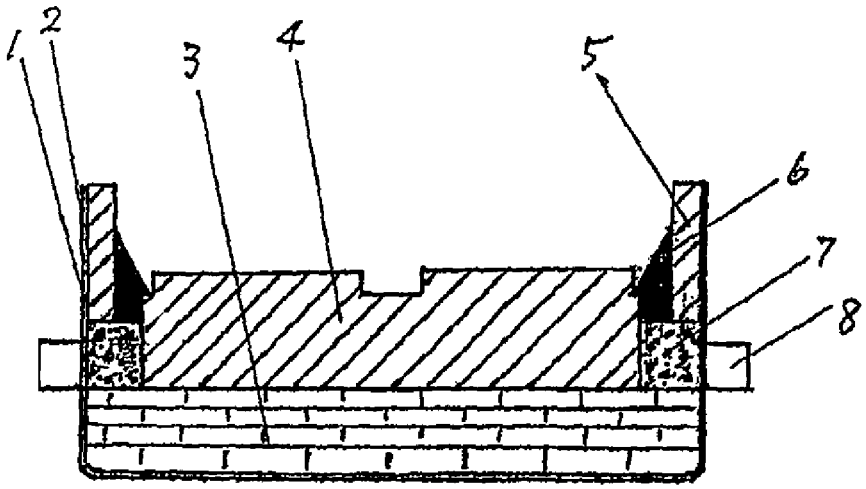
FIG. 2 is a side view of FIG. 1.
Figure 3:
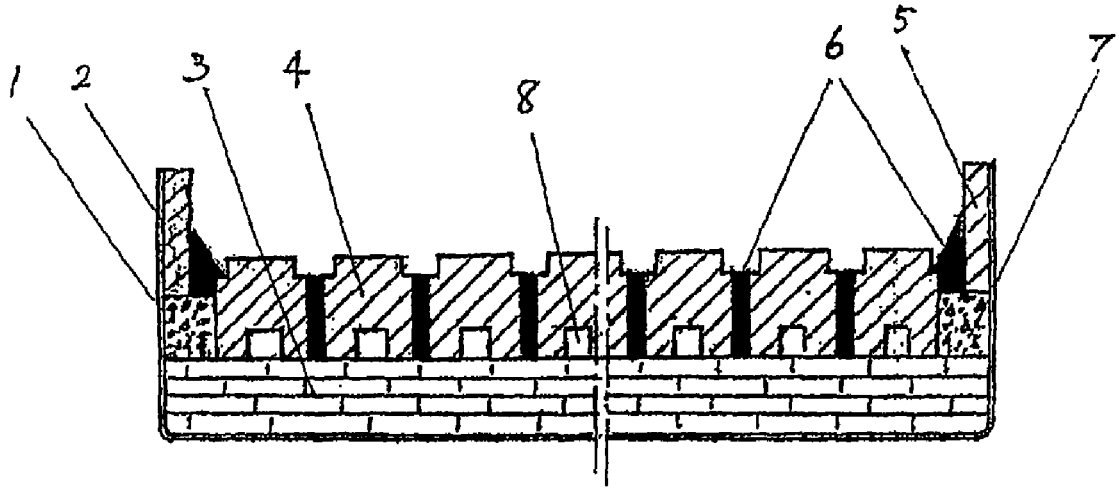
FIG. 3 is shown a structural view for an aluminum electrolytic cell having one protruding portion on an upper surface of each cathode carbon block according to one embodiment of the present invention, wherein the cross section of the protruding portion vertical to longitudinal direction of the cathode carbon block is shaped in rectangle.
Figure 4:
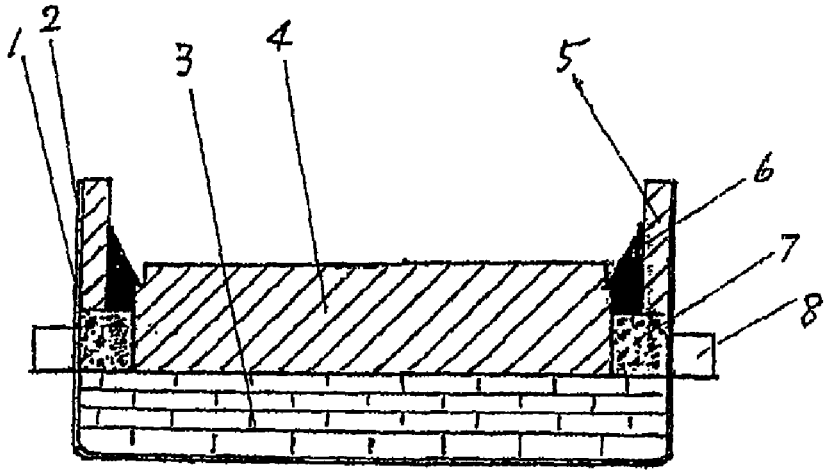
FIG. 4 is a side view of FIG. 3.
Figure 5:
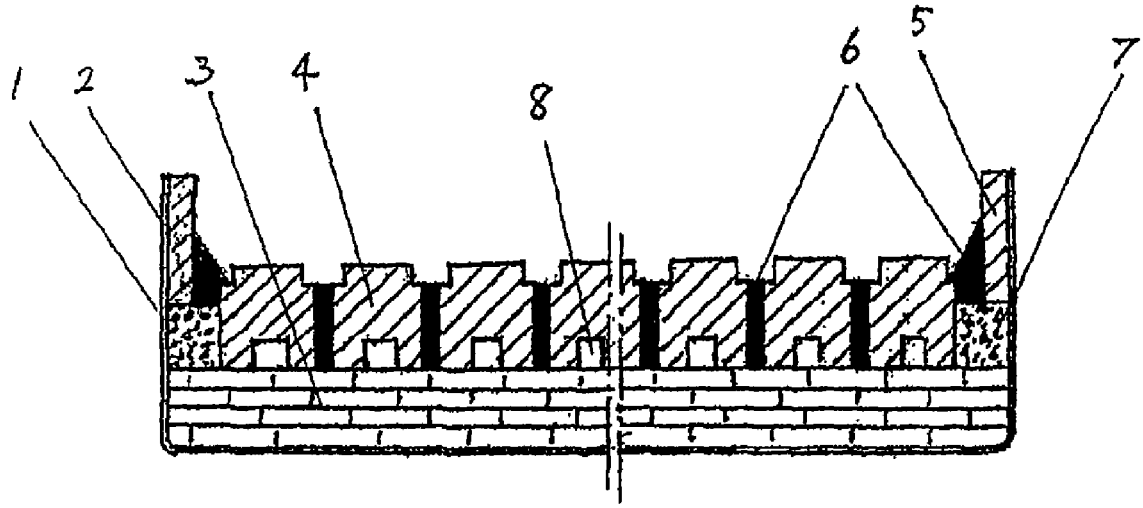
FIG. 5 is shown a structural view for an aluminum electrolytic cell having six protruding portions on an upper surface of each cathode carbon block according to one embodiment of the present invention, wherein the cross section of the protruding portion vertical to longitudinal direction of the cathode carbon block is shaped in rectangle.
Figure 6:
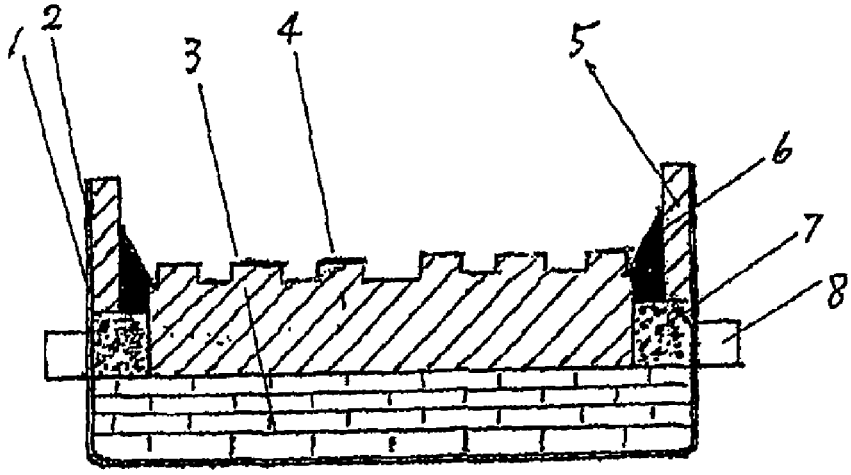
FIG. 6 is a side view of FIG. 5.
Figure 7:
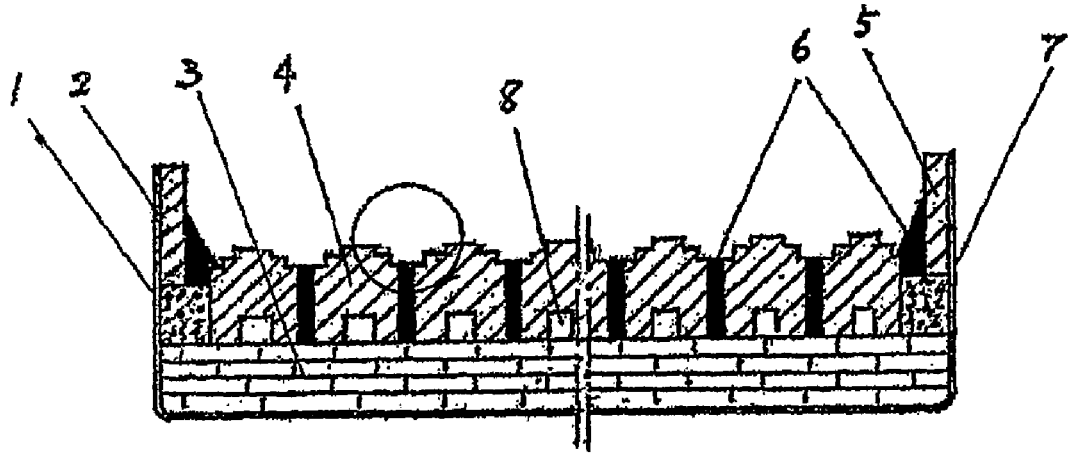
FIG. 7 is shown a structural view for an aluminum electrolytic cell having two protruding portions on an upper surface of each cathode carbon block according to one embodiment of the present invention, wherein the cross section of the protruding portion vertical to longitudinal direction of the cathode carbon block is shaped in stair steps.
Figure 8:
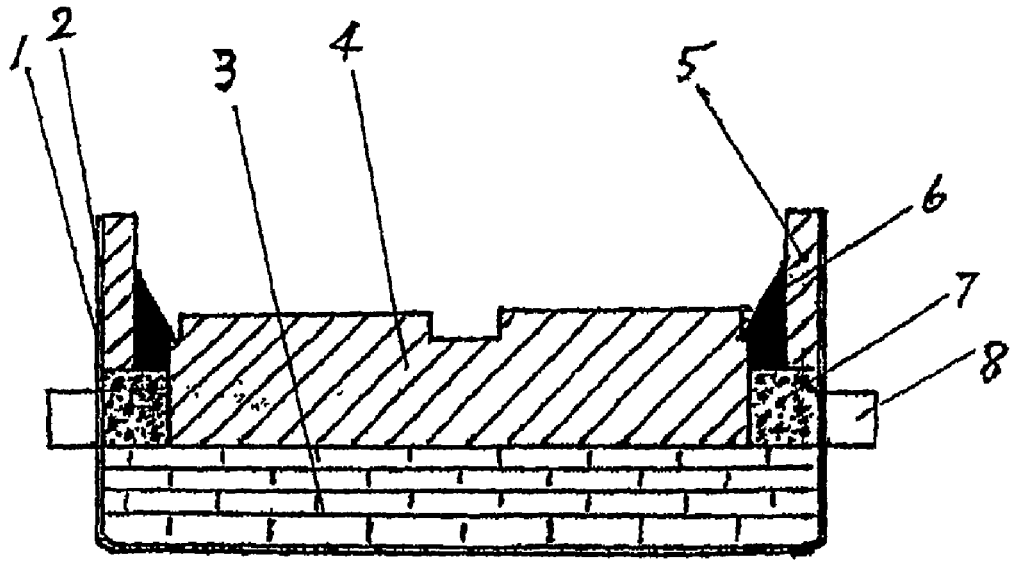
FIG. 8 is a side view of FIG. 7.
Figure 9:
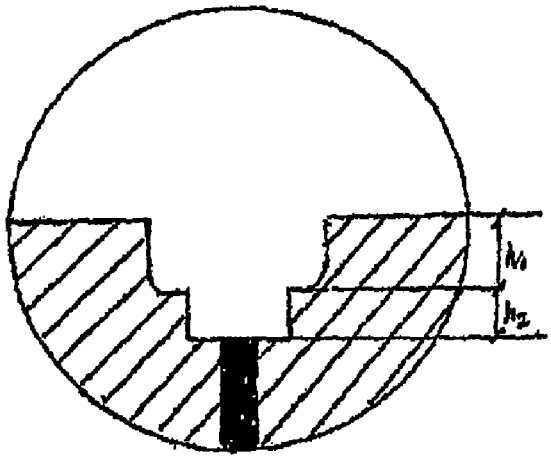
FIG. 9 is a partially enlarged view of FIG. 7
Figure 10:
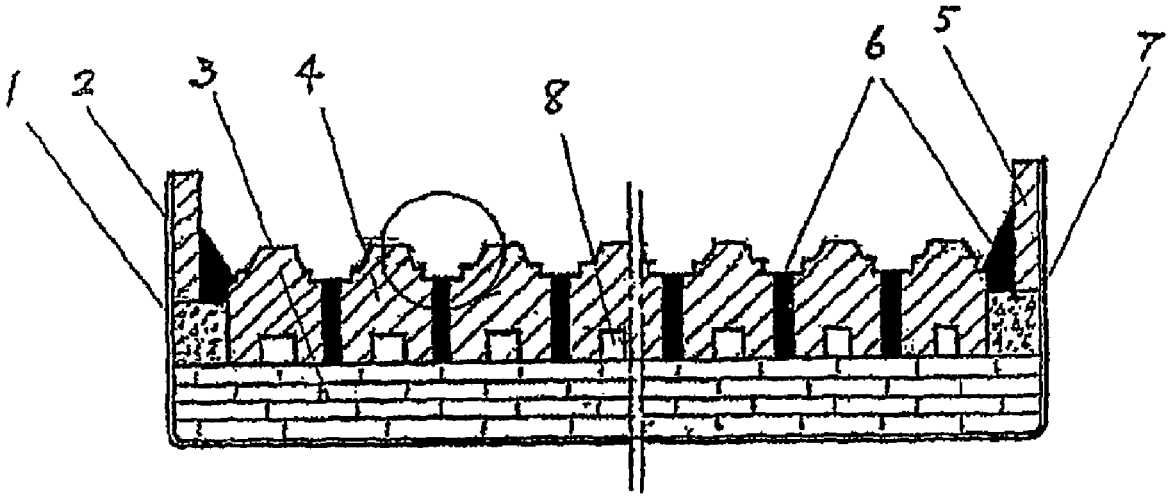
FIG. 10 is shown a structural view for the cathode carbon blocks having another shaped protruding portion according to the present invention.
Figure 11:
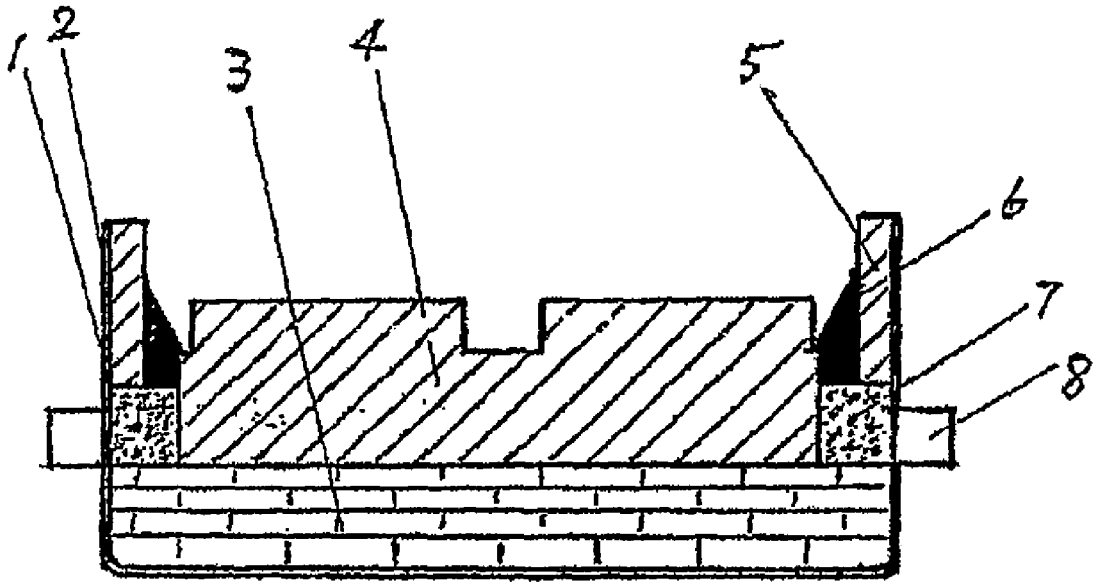
FIG. 11 is a side view of FIG. 10.
Figure 12:
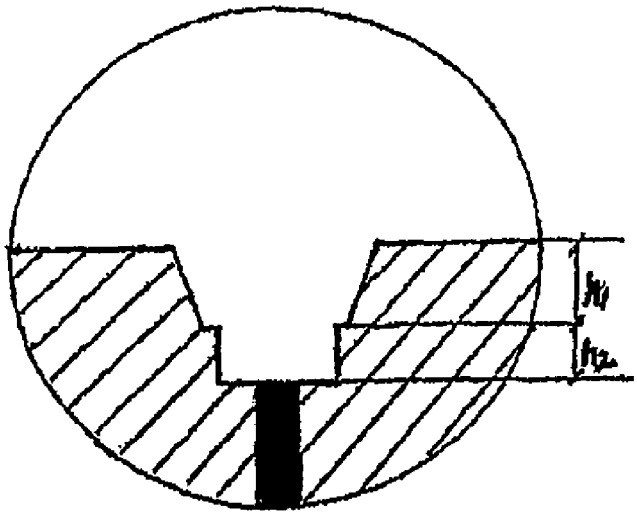
FIG. 12 is a partially enlarged view of FIG. 10.

Wherein, the explanatory notes for the reference numerals are as following:

1. Steel cell case outside the electrolytic cell;

2. Asbestos board internally lined in the electrolytic cell;

3. Refractory materials and heat insulating materials at the bottom of the electrolytic cell;

4. Cathode blocks having protruding portions on the upper surface thereof at the bottom of the electrolytic cell;

5. Side carbon blocks internally lined in the side portion of the electrolytic cell;

6. Carbon pastes between the side carbon blocks and the bottom carbon blocks having protruding portions on the upper surface thereof, as well as between the bottom carbon blocks having protruding portions on the upper surface thereof;

7. Refractory concretes below the carbon blocks at the side;

8. Cathode steel rod.

DETAILED DESCRIPTION OF PREFERRED EMBODIMENTS

As shown in FIG. 1, an aluminum electrolytic cell having profiled cathode carbon blocks structures has a coverless rectangular case structure. The outside thereof comprises a steel cell case 1, and the steel cell case 1 is lined with an asbestos board 2. Refractory materials and heat insulating materials 3 are provided on the asbestos board 2 lining within the cell case 1, and cathode carbon blocks at cell bottom 4, each of which the upper surface includes protruding portions, are provided on the refractory materials and the heat insulating materials 3, wherein the profiled cathode carbon blocks 4 with the upper surface thereof having protruding portions are made from anthracites or artificial graphite crumbs or the compound thereof Alternatively, such cathode carbon blocks 4 with the upper surface thereof having protruding portions can be made of graphitized or semi-graphitized carbon blocks. The protruding portions of the profiled cathode carbon blocks 4 each has a width less than the width of a base at the lower portion of the cathode block, and the height of the protruding portion may has a range from 50 to 200 mm. Carbon blocks 5 lined within the side of the electrolytic cell are also made from anthracites or artificial graphite crumbs or the compound thereof, or graphitized or semi-graphitized carbon blocks. Similarly, it can be made from carborundum materials. The cell bottom cathode internal liner within the electrolytic cell is structured by a plurality of profiled carbon blocks 4 having cathode steel rods 8 provided at the bottom thereof and protruding portions provided on the upper surface thereof. Each profiled carbon block 4 having protruding portions disposed on the upper surface thereof is transversally disposed in the electrolytic cell, and the length direction of the profiled carbon blocks 4 having protruding portions provided on the upper surface thereof is perpendicular to the longitudinal direction of the electrolytic cell. A gap sized around 20-40 mm is provided between non-protruding portions of two adjacent profiled carbon blocks 4, and is tamped with carbon pastes 6 therebetween. Refractory concretes 7 are tamped below the side internal carbon blocks 5 and above the bottom refractory bricks 3, also carbon pastes 6 are tamped between the side carbon blocks 5 and non-protruding portion of the bottom profiled cathode carbon blocks 4. The bottom profiled cathode carbon blocks 4 having protruding portions on the upper surfaces thereof are opened with grooves at lower surfaces thereof for mounting the cathode steel rods 8, which both ends thereof extend out of the cell case 1 of the electrolytic cell and serves as a cathode of the electrolytic cell.

As shown in drawings, the profiled cathode structured aluminum electrolytic cell is somewhat similar to the existing aluminum electrolytic cell in the cell body, the cell case, structure of internal lined refractory and heat insulating materials, carbon blocks structure internally lined within the side portion and cathode steel rod structure, as well as carbon pastes structure between the carbon blocks. However, the shape and the structure of the bottom cathode carbon block of the electrolytic cell is significantly different from those of the prior arts.

Since the electrolytic cell according to the present invention employs profiled cathode carbon blocks having protruding portions on the surfaces thereof on the bottom liner of the cell, the profiled cathode carbon blocks 4 each has a non-protruding portion at the lower portion thereof having width larger than that of the protruding portion, and the carbon pastes 6 only can be tamped between the non-protruding portions of the profiled cathode carbon blocks 4, thus, rows of protruding walls are formed by the protruding portions of the profiled cathode carbon blocks 4 at the bottom of the electrolytic cell. Such walls are formed into components of cathode blocks of the electrolytic cell. Each cathode block may have 1 to 8 protruding walls on the upper surface thereof. If each cathode block has 2 protruding walls, each protruding wall has a length identical with the length of the anode provided thereon and perpendicular to longitudinal direction of the electrolytic cell, and the width thereof is smaller than the width of the base cathode carbon blocks at the bottom thereof.

If each cathode bottom block has one protruding wall on the upper surface thereof, the length of the protruding wall is identical with that of the bottom cathode carbon blocks; if the cathode bottom block has two and more protruding walls on the upper surface thereof, the length thereof are smaller that that of the bottom cathode carbon blocks.

The cross section of protruding portions of the cathode carbon block may be shaped in rectangle, or any other protruding shape. If it is shaped in rectangle, the height of the protruding portions on the upper surface of the cathode carbon blocks is about 50-200 mm and the width thereof is about 200-350 mm. If the cross section of the protruding portion is shaped in a protruding shape or step shape, the lower portion of the protruding shape is about 30-100 mm and the upper portion of the protruding shape is about 30-150 mm.

A method for producing metal aluminum by using the aluminum electrolytic cell having profiled cathode carbon blocks structure provided in the present invention, comprising:

1. Building and constructing an electrolytic cell according to the aluminum electrolytic cell having profiled cathode carbon blocks structure provided in the present invention.

2. According to the same burning and starting method as those used in the existing aluminum electrolytic cell, burning and starting of the aluminum electrolytic cell having profiled cathode carbon blocks structure of the present invention is performed. However, carbon powder is required to fill in gaps between whole walls protruded on the cell bottom before burning, when using scorched particles burning method.

3. During the normal manufacture technical management after the electrolytic cell starts, the molten aluminum level within the electrolytic cell is calculated from the upper surfaces of the walls protruded from the surface of the cell bottom; the height thereof is about 30-200 mm after the aluminum is generated. In the normal manufacturing, the inter electrode distance of the electrolytic cell is about 25-50 mm, and the cell voltage is about 3.0-4.5 v.

4. Pelletized bumps or powders made from over 30-70% of powder alumina and 70%-30% of powder cryolite are filled between the lower portion of walls protruded from the bottom surface of the aluminum electrolytic cell having profiled cathode carbon blocks structure, such pelletized bumps or powders are under the electrolytic temperature, when the cryolite therein is molten, the molten cryolite is formed into a kind of precipitate on the cell bottom to seal the cracks and gaps so as to prevent the molten aluminum from entering into the cell bottom to melt the cathode steel rod and damage the electrolytic cell. Except above two steps, when using in the normal manufacturing, other process and technical conditions of the aluminum electrolytic cell having profiled cathode carbon blocks structure with protruding portions provided on the upper surface according to the present invention are the same as those in the aluminum electrolytic cell having cathode structure in the prior art, those technical conditions may include: the electrolyte level is about 15-25 cm, the molecular ratio of the electrolyte is about 2.0-2.8, the concentration of alumina is about 1.5-5%, the electrolyte temperature is about 935-975° C.

Under above process conditions, the electrolytic reaction reacted on the cathode of the electrolytic reaction is: $Al^{3+}$ (complex)+3e=Al.

The invention claimed is:

1. An aluminum electrolytic cell having heterotypic structured cathode carbon blocks, comprising: a cell case, a carbon anode, a bottom carbon internal lining, and refractory and heat insulating materials provided between the bottom carbon internal lining and the cell case, the bottom carbon internal lining being composed of a plurality of cathode carbon blocks, wherein a longitudinal direction of the cathode carbon block is perpendicular to a longitudinal direction of the cell case, wherein each cathode carbon block comprises a connecting part at a bottom end of the cathode carbon block and a protruding part at a top end of the cathode carbon block, the connecting part being formed integrally with the protruding part, wherein the connecting parts of the adjacent cathode carbon blocks are connected by tamping carbon pastes, wherein grooves extending in the longitudinal direction of the cathode carbon block are formed between the adjacent protruding parts of the adjacent cathode carbon blocks, wherein each protruding part of the cathode carbon block comprises 2-8 protruding portions which are arranged at a predetermined interval in the longitudinal direction of the cathode carbon block to form between adjacent protruding portions a slot extending in the longitudinal direction of the cell case, and wherein a height of molten aluminum within the electrolytic cell from the upper surfaces of the protruding portions is about 30-200 mm after the aluminum is generated.

2. The aluminum electrolytic cell having heterotypic structured cathode carbon blocks of claim 1, wherein the protruding portion comprises an upper portion and a lower portion, and in a cross section perpendicular to the longitudinal direction of the cathode carbon block, the width of the lower portion is larger than the width of the upper portion, pelletized feed stock or powder stuff made from over 30-70% of powder alumina and 70%-30% of powder cryolite are filled between recesses formed between the lower portions of the adjacent protruding portions of the adjacent cathode carbon blocks.

3. The aluminum electrolytic cell having heterotypic structured cathode carbon blocks of claim 1, wherein pelletized feed stock or powder stuff made from over 30-70% of powder alumina and 70%-30% of powder cryolite are filled between recesses formed between lower sections of the adjacent protruding parts of the adjacent cathode carbon blocks.

* * * * *